US012018672B2

(12) United States Patent
Heintzelman et al.

(10) Patent No.: US 12,018,672 B2
(45) Date of Patent: Jun. 25, 2024

(54) PRECISION VOLUMETRIC PUMP WITH A BELLOWS HERMETIC SEAL

(71) Applicant: IDEX HEALTH AND SCIENCE LLC, Middleborough, MA (US)

(72) Inventors: Dale Heintzelman, East Bridgewater, MA (US); John Fulton, Middleborough, MA (US); Andrew Shaw, Providence, RI (US); Victoria Danner, Brighton, MA (US); Mindy Darosa, Swansea, MA (US); Ruairidh MacCrimmon, Maynard, MA (US)

(73) Assignee: IDEX HEALTH AND SCIENCE LLC, Middleborough, MA (US)

( * ) Notice: Subject to any disclaimer, the term of this patent is extended or adjusted under 35 U.S.C. 154(b) by 0 days.

(21) Appl. No.: 17/210,709

(22) Filed: Mar. 24, 2021

(65) Prior Publication Data

US 2021/0310477 A1 Oct. 7, 2021

Related U.S. Application Data

(60) Provisional application No. 63/004,126, filed on Apr. 2, 2020.

(51) Int. Cl.
*F04B 45/027* (2006.01)

(52) U.S. Cl.
CPC ..... *F04B 45/027* (2013.01); *F04B 2205/503* (2013.01)

(58) Field of Classification Search
CPC . F04B 45/02–027; F04B 53/14; F04B 53/143
USPC ..... 417/472–473
See application file for complete search history.

(56) References Cited

U.S. PATENT DOCUMENTS

| | | | |
|---|---|---|---|
| 2,058,098 | A | 10/1936 | O'Neil et al. |
| 2,464,095 | A | 3/1949 | Nies |
| 2,686,006 | A | 8/1954 | Hasselquist |
| 3,077,122 | A | 2/1963 | Olsen |
| 3,494,512 | A | 2/1970 | Haynes |
| 3,514,221 | A | 5/1970 | Hasquenoph et al. |
| 3,524,714 | A | 8/1970 | Grove et al. |
| 3,529,908 | A | 9/1970 | Smith |

(Continued)

FOREIGN PATENT DOCUMENTS

| | | |
|---|---|---|
| CN | 2608720 | 3/2004 |
| CN | 102057160 | 5/2013 |

(Continued)

OTHER PUBLICATIONS tantaline.com, URL: https://tantaline.com/DOCS/Application-Fact-Sheets/ApplicationNote-Tantaline-Bellows.pdf (Year: 2017).*

(Continued)

*Primary Examiner* — Thomas Fink
(74) *Attorney, Agent, or Firm* — Kilpatrick Townsend & Stockton LLP

(57) ABSTRACT

A precision volumetric pump with a bellows hermetic seal provides compliance time performance comparable to a conventional pump having a dynamic seal. However, the precision volumetric pump with a bellows hermetic seal is enabled to operate over a very long service life with minimal or no maintenance without a propensity to develop leaks over the long service life.

24 Claims, 7 Drawing Sheets

(56) References Cited

U.S. PATENT DOCUMENTS

| | | | | |
|---|---|---|---|---|
| 3,650,429 | A | 3/1972 | Ribout | |
| 3,711,972 | A | 1/1973 | Risacher | |
| 3,765,705 | A | 10/1973 | Tantam | |
| 3,831,499 | A | 8/1974 | Andrews et al. | |
| 3,942,584 | A | 3/1976 | Wieser | |
| 4,047,851 | A | 9/1977 | Bender | |
| 4,231,724 | A * | 11/1980 | Hope | F04B 53/1065 417/571 |
| 4,285,710 | A | 8/1981 | Welch | |
| D296,556 | S | 7/1988 | Sato et al. | |
| 5,096,093 | A | 3/1992 | Wells | |
| 5,098,377 | A | 3/1992 | Borsanyi et al. | |
| 5,195,878 | A | 3/1993 | Sahiavo et al. | |
| 5,289,611 | A | 3/1994 | Yonkers et al. | |
| 5,638,986 | A | 6/1997 | Tuominen et al. | |
| 5,718,248 | A | 2/1998 | Trumble et al. | |
| 5,792,108 | A | 8/1998 | Felix et al. | |
| 6,367,659 | B1 | 4/2002 | Seidler | |
| 6,814,553 | B2 | 11/2004 | Watanabe et al. | |
| 6,869,571 | B2 | 3/2005 | Ingenhoven et al. | |
| 6,966,339 | B2 | 11/2005 | Oniduka et al. | |
| 7,185,709 | B2 | 3/2007 | Schetky et al. | |
| 7,316,336 | B2 | 1/2008 | Kaartinen | |
| 7,322,803 | B2 | 1/2008 | Vogeley | |
| 7,481,337 | B2 | 1/2009 | Luharuka et al. | |
| 8,133,184 | B2 | 3/2012 | Williams et al. | |
| 8,182,521 | B2 | 5/2012 | Kane et al. | |
| 8,287,806 | B2 | 10/2012 | Bjornson et al. | |
| 8,524,311 | B1 | 9/2013 | Greenberg et al. | |
| 8,603,150 | B2 | 12/2013 | Kane et al. | |
| 8,660,327 | B2 | 2/2014 | Hundley et al. | |
| 9,056,291 | B2 | 6/2015 | Battrell et al. | |
| 9,239,047 | B2 | 1/2016 | Iwabuchi et al. | |
| 9,308,148 | B2 | 4/2016 | Kane et al. | |
| 9,435,765 | B2 | 9/2016 | Reimitz et al. | |
| 9,561,312 | B2 | 2/2017 | Heaton et al. | |
| 9,598,226 | B2 | 3/2017 | Kuehn et al. | |
| 9,915,183 | B2 | 3/2018 | Sealy et al. | |
| 9,964,229 | B2 | 5/2018 | Sealy et al. | |
| 10,286,415 | B2 | 5/2019 | Lithell et al. | |
| 2004/0056048 | A1 | 3/2004 | Kaartinen | |
| 2004/0265149 | A1 | 12/2004 | Harigaya et al. | |
| 2005/0033232 | A1* | 2/2005 | Kriesel | A61M 5/1454 604/131 |
| 2005/0191195 | A1 | 9/2005 | Oniduka et al. | |
| 2005/0220647 | A1 | 10/2005 | Liepert et al. | |
| 2006/0196541 | A1 | 9/2006 | Gerken et al. | |
| 2007/0020763 | A1 | 1/2007 | Ingenhoven et al. | |
| 2007/0140916 | A1 | 6/2007 | Spiss | |
| 2008/0124236 | A1 | 5/2008 | Schofield | |
| 2009/0071754 | A1 | 3/2009 | McArthur | |
| 2009/0142205 | A1* | 6/2009 | Yajima | F04B 43/084 417/375 |
| 2010/0233002 | A1 | 9/2010 | Collie | |
| 2011/0091340 | A1 | 4/2011 | Sunagawa | |
| 2014/0138399 | A1* | 5/2014 | Estelle | B05C 11/1002 417/63 |
| 2014/0301879 | A1 | 10/2014 | Calhoun et al. | |
| 2017/0008016 | A1 | 1/2017 | Lithell et al. | |
| 2017/0241451 | A1* | 8/2017 | Jewett | F02F 1/18 |
| 2017/0248129 | A1* | 8/2017 | Rossetti | F04B 7/0007 |
| 2018/0051692 | A1 | 2/2018 | Oniduka | |

FOREIGN PATENT DOCUMENTS

| | | | |
|---|---|---|---|
| DE | 1503464 | A1 | 7/1969 |
| DE | 2406875 | | 8/1975 |
| EP | 0061699 | | 10/1982 |
| EP | 0494375 | | 7/1992 |
| EP | 0595279 | | 5/1994 |
| EP | 0720951 | | 9/1998 |
| EP | 0867622 | | 9/1998 |
| EP | 2943278 | | 2/2019 |
| GB | 1227009 | | 3/1971 |
| GB | 1263444 | | 2/1972 |
| GB | 1279418 | | 6/1972 |
| GB | 1333295 | | 10/1973 |
| GB | 1337546 | | 11/1973 |
| GB | 1383935 | | 2/1974 |
| GB | 2507772 | | 5/2014 |
| GB | 2560014 | | 8/2018 |
| JP | 5770972 | | 5/1982 |
| JP | 5813180 | | 1/1983 |
| JP | 58110871 | | 7/1983 |
| JP | 6093190 | | 5/1985 |
| JP | 62267580 | | 11/1987 |
| JP | 0529207 | | 2/1993 |
| JP | 0617752 | | 1/1994 |
| JP | 0883759 | | 3/1996 |
| JP | 10235583 | | 9/1998 |
| JP | 10281069 | | 10/1998 |
| JP | 10323607 | | 12/1998 |
| JP | 11117872 | | 4/1999 |
| JP | 11125173 | | 5/1999 |
| JP | 11210667 | | 8/1999 |
| JP | 2000234589 | | 8/2000 |
| JP | 2000329068 | | 11/2000 |
| JP | 2001020868 | | 1/2001 |
| JP | 2001291672 | | 10/2001 |
| JP | 2002174180 | | 6/2002 |
| JP | 2002257049 | | 9/2002 |
| JP | 2002296243 | | 10/2002 |
| JP | 2003314714 | | 11/2003 |
| JP | 2004020474 | | 1/2004 |
| JP | 2004257262 | A | 9/2004 |
| JP | 2006200429 | | 8/2006 |
| JP | 2007085217 | | 4/2007 |
| JP | 2007117787 | | 5/2007 |
| JP | 2007154767 | | 6/2007 |
| JP | 3989334 | | 7/2007 |
| JP | 2007303402 | | 11/2007 |
| JP | 4695503 | | 3/2011 |
| JP | 2013160238 | | 8/2013 |
| JP | 2016065532 | | 4/2016 |
| JP | 2017150401 | A * | 8/2017 |
| JP | 2018003709 | | 1/2018 |
| KR | 0167481 | | 2/1999 |
| WO | 2006005923 | | 1/2006 |
| WO | 2007092115 | | 8/2007 |
| WO | 2009072347 | | 6/2009 |
| WO | 2010115430 | | 10/2010 |
| WO | 2016006043 | | 1/2016 |
| WO | 2016163306 | | 10/2016 |
| WO | 2017009375 | | 1/2017 |
| WO | 2017077318 | | 5/2017 |
| WO | 2017144857 | | 8/2017 |
| WO | 2018112441 | | 6/2018 |

OTHER PUBLICATIONS

Aculon, Hydrophilic Tantalum Coatings, URL: https://www.aculon.com/hydrophilic-tantalum/ (Year: 2022).*

Application No. PCT/US2021/023845 , International Search Report and Written Opinion, Mailed On Jun. 4, 2021, 7 pages.

40 Years of Cavro, Corporate News, Tecan Journal, Available Online at: https://www.tecan.com/hubfs/Tecan_Journal/201203/06_07_40_years_of_Cavro_032012.pdf., Mar. 2012, pp. 6-7.

A Brief History of Pumps, World Pumps, vol. 508, Available Online at: https://doi.org/10.1016/S0262-1762(09)70028-8, Jan. 2009, pp. 30-37.

KBR Bellows Pump, Iwaki, Available Online at: https://www.iwakiamerica.com/products/Bellows.htm?vsrefdom=adwords&gclid=CjwKCAjw_fnBRANEiwAuFxETAvaWtOwk8HLc9D9OCQn3V2uuWcWwo3_nUpn9IAH5sKiQRUShWXihoCFEIQAvD_BWE, Sep. 2018, 2 pages.

LCM Pump, Stratec, Available Online at: https://www.stratec.com/solutions/instrumentation?file=files/inhalte/images_stratec_group/Solutions/Instrumentation/Detail/ModuleBrochure-LCM-PUMP-5000.pdf, 2019, 4 pages.

Pump, Wikipedia, Available Online at: https://en.wikipedia.org/wiki/Pump, 2019, 13 pages.

(56) References Cited

OTHER PUBLICATIONS

The History of Pumps: And the Journey and Evolution through the Years, Pump Manufacturers, Sintech Pumps India, Available Online at: https://www.sintechpumps.com/industrial-pumps/history-of-pumps/, Jul. 17, 2018, 10 pages.
The History of Pumps: Through the Years, Pumps & Systems, Available Online at: https://www.pumpsandsystems.com/history-pumps-through-years, Dec. 22, 2011, 13 pages.
Anton et al., Performance of Turbomolecular Pumps in an Extended TEM Specimen Chamber Equipped for in-situ Vapour Deposition Experiments, Ultramicroscopy, vol. 41, No. 2, Available Online at: https://doi.org/10.1016/0304-3991(92)90210-B, 1992, pp. 303-316.
Balmer, Flexing Welded Bellows Pumps Clean Air, vol. 26, No. 3, 1971.
Ferguson-Pell et al., A Skin Indentation System Using a Pneumatic Bellows, Journal of Rehabilitation Research and Development, vol. 31 No. 1, 1994, pp. 15-19.
Fontecchio, Bellows Pumps Help Investigate Ocean Chemical Changes, Sea Technology, vol. 19, No. 10, 1978, pp. 19-20.
Green, A Superconducting Linear Motor Drive for a Positive Displacement Bellows Pump for Use in the g-2 Cryogenics System, Institute of Electrical and Electronics Engineers, Transactions on Applied Superconductivity, vol. 5, No. 2, Jun. 1995, pp. 972-975.
Haag, Interchangeability of Gas Detection Tubes and Hand Pumps, AIHAJ Fairfax, vol. 62, No. 1, 2001, pp. 65-69.
Hablanian et al., Design and Performance of Oil-Free Pumps, Vacuum, vol. 41, No. 7-9, Available Online at: https://doi.org/10.1016/0042-207X(90)94101-U, 1990, pp. 1814-1818.
Hashimoto et al., Flow Control in an Artificial Heart—Ventricular Pressure in the Piston-bellows Pump, Artificial Organs, vol. 5, No. 3, Aug. 1981, p. 337.
Hashimoto, Flow-Control in an Artificial-Heart—Affecting Factors on Pulsatile Flow in the Piston-Bellows Pump, Artificial Organs, vol. 5, No. 3, Aug. 1981, p. 313.
Hurlbatt, A Brief History of Water Pumps and How They Have Affected the World, Pump Solutions Australasia, Available Online at: https://pumpsolutions.com.au/a-brief-history-of-water-pumps-and-how-they-have-affected-the-world/, Apr. 13, 2016, 2 pages.
Luharuka et al., Design, Fabrication, and Testing of a Near Constant Pressure Fuel Delivery System for Miniature Fuel Cells, Sensors and Actuators A: Physical, vol. 112, Nos. 2-3, Available Online at: https://doi.org/10.1016/j.sna.2004.01.013, May 1, 2004, pp. 187-195.
Morrissey, A New Shaft Sealing Solution for Small Cryogenic Pumps, Tribology Transactions, vol. 39, No. 4, Available Online at: https://doi.org/10.1080/10402009608983619, 1996, pp. 964-968.
Ogawa et al., Double-Balanced Bellows for Vibration Isolation between the inside and Outside of a Vacuum; Application to Gravitational-Wave Experiments, Vacuum, vol. 44, No. 5-7, Available Online at: https://doi.org/10.1016/0042-207X(93)90074-K, 1993, pp. 465-468.
Park et al., Resonantly Driven Piezoelectric Micropump, Mechatronics, 1998, pp. 441-444.
Park et al., Resonantly Driven Piezoelectric Micropump Fabrication of a Micropump Having High Power Density, Mechatronics, vol. 9, Available Online at: https://doi.org/10.1016/S09574158(99)00028-8, 1999, pp. 687-702.
Singh et al., On Extensive Pump Handling of Chemical-Mechanical Polishing Slurries, In 2001 IEEE/SEMI Advanced Semiconductor Manufacturing Conference (IEEE Cat. No. 01CH37160), Available online at https://doi.org/10.1109/ASMC.2001.925627, 2001, pp. 107-113.
Smith et al., Development and Applications of a 300 KeV Ultrahigh-vacuum High-resolution Electron Microscope, Ultramicroscopy, vol. 49, No. 1, Available Online at: https://doi.org/10.1016/0304-3991(93)90210-O, 1993, pp. 26-36.
Trumble et al., Muscle Powered Blood Pump: Design and Initial Test Results, ASAIO Journal, vol. 45, No. 3, May-Jun. 1999, pp. 178-182.
Welch, Evaluating Gas Aspiration and Bellows Roughing Pumps, Res.-Dev, Mechanical, 1972, 2 pages.
Wen et al., Analysis of Feature and Welding Consideration for Metal Bellows, Key Engineering Materials, vol. 486, Available Online at: https://doi.org/10.4028/www.scientific.net/KEM.486.225, Jul. 2011, pp. 225-228.
Wold, Liquid Handling Pump Selection: a Guide for Lab Automation Engineers, Tecan, Available Online at: https://www.tecan.com/blog/pump-selection-guide-for-systems-engineers, Accessed from Internet on Jun. 5, 2019, 9 pages.
Yuh et al., Construction of a Manipulator with Six Degrees of Freedom and a Rotary Platform Differentially Pumped via Retractable Welded Bellows, Vacuum, vol. 121, Available Online at: https://doi.org/10.1016/j.vacuum.2014.12.008, 2015, pp. 283-288.
"Bellows Pump Instructions", Iwaki America, Available Online at: https://www.iwakiamerica.com/Literature/180295_Bellows_Instructions.pdf., Dec. 2012, 4 pages.
"Bellows Pumps Nippon Pillar", Available online at http://www.nipponpillar.com/products/semiconductor/pumps/, Accessed from Internet from Mar. 15, 2021, 1 page.
"Cavro® Liquid Handling Pumps", Pump Technologies, Available Online at: https://partnering.tecan.com/cavro-liquid-handling-pumps, Accessed from Internet on Mar. 12, 2021, 5 pages.
"Detector Tubes and Pumps", Available online at http://site.msagasmonitors.com/MSA/pdf/kwik-draw-deluxe-detector-tube-pump_datasheet.pdf, Accessed from Internet from Jun. 11, 2019, 12 pages.
"Dispense Pumps", The Lee Company, Available Online at: https://www.theleeco.com/products/electro-fluidic-systems/dispense-pumps/, Accessed from Internet on Mar. 12, 2021, 4 pages.
"Dräger Accuro Drager-Tube Pump", Available online at https://www.draeger.com/Products/Content/tube-pump-accuro-pi-9045595-en-gb.pdf, Accessed from Internet from Jun. 11, 2019, 8 pages.
"Dräger Accuro®", Available online at https://www.draeger.com/en-us_ca/Applications/Products/Mobile-Gas-Detection/Draeger-Tubes-and-CMS/Draeger-Tube-Pumps/Tube-pump-accuro, Accessed from Internet from Mar. 12, 2021, 6 pages.
"Dräger Accuro® 2000 Operation Manual", Available online at: http://www.equipcoservices.com/pdf/manuals/drager_accuro.pdf, Accessed from Internet from Jun. 11, 2019, 10 pages.
"EA Piston Pump", Pump, Available Online at: http://www.foreachtek.com/en/ProductList.aspx?TypeId=10033, Accessed from Internet on Mar. 12, 2021, 3 pages.
"Glutton Plunger Pumps", Available Online at: https://www.graco.com/gb/en/products/finishing/glutton-plunger-pumps.html, Accessed from Internet on Mar. 12, 2021, 10 pages.
"GRI Service Data Sheet", GRI Pumps, Available Online at: https://archive-resources.coleparmer.com/Manual_pdfs/07192-10%20to%2095.pdf, believed to be published by Apr. 1, 2020, 4 pages.
"GRI Standard Bellows Pumps Overview", GRI Pumps, Available Online at: https://www.gripumps.com/media/1162/gri-standard-bellows-pumps-overview-0818a.pdf, believed to be published by Apr. 1, 2020, 24 pages.
"Hytec SPX FLOW Global Industrial Equipment & Global Manufacturing", Available online at http://www.spxflow.com/en/hytec/, Accessed from Internet from Mar. 15, 2021, 5 pages.
"IMI Norgren M_31000_32000 Bellows Datasheet", IMI Norgren, Available Online at: https://d25g25bk48as5o.cloudfront.net/pdf/en_1_8_005_M_31000_32000.pdf, Accessed from Internet on Jun. 5, 2019, 8 pages.
"IWAKI Bellows Pump KBR SERIES Instruction Manual", IWAKI Pumps, Accessed from Internet on Jun. 10, 2019, 12 pages.
"Keyto Pumps", Firefox, Available Online at: http://www.keytofluid.com/en/product.aspx?ProductsCateID=93&CateID=93&CurrCateID=90&CurrsubCateID=93, Accessed from Internet on Mar. 12, 2021, 2 pages.
"Kwik-Draw Sampling Pump Operation and Maintenance", Available online at https://www.uniphosamericas.com/wp-content/uploads/2017/04/KwikDraw-pump-manual-P.N.-487500.pdf, Accessed from Internet from Jun. 11, 2019, 2 pages.
"Maestro Piston Pump", Bio-Chem Fluidics, Available Online at: https://biochemfluidics.com/products/maestro-piston-pump, Accessed from Internet on Mar. 12, 2021, 7 pages.

(56) References Cited

OTHER PUBLICATIONS

"Maestro ULTRA Piston Pump", Bio-Chem Fluidics, Available Online at: https://biochemfluidics.com/products/maestro-ultra-piston-pump, Accessed from Internet on Mar. 12, 2021, 5 pages.
"Merkur Bellows Pumps", Available Online at: https://www.graco.com/gb/en/products/finishing/merkur-bellows-piston-pumps.html, Accessed from Internet on Mar. 12, 2021, 16 pages.
"Micro Piston Pump", Longer, MP series piston pump-Longer Precision Pump Co., Ltd., Available Online at: https://www.longerpump.com/index.php/MicroPistonPumps/, Accessed from Internet on Mar. 12, 2021, 2 pages.
"MSA Kwik-draw Deluxe Detector Tube Pump, with End-of-stroke Indicator, Remote Sampling Adapter and Carrying Pouch—487500", Available online at https://www.msagasmonitors.com/487500.html, Accessed from Internet from Mar. 12, 2021, 4 pages.
"OEM Peristaltic Pump", Longer, OEM Peristaltic Pump-Longer Precision Pump Co., Ltd., Available Online at: https://www.longerpump.com/index.php/OEM/, Accessed from Internet on Mar. 12, 2021, 2 pages.
"Other Pump", Longer, Micro gear pump-Longer Precision Pump Co., Ltd., Available Online at: https://www.longerpump.com/index.php/PumpSystem/, Accessed from Internet on Mar. 12, 2021, 2 pages.
"Our Instrumentation Expertise", Stratec, Available Online at: https://www.stratec.com/solutions/instrumentation, Accessed from Internet on Mar. 12, 2021, 9 pages.
"Patent Portfolio", Tecan Intellectual Property, Available Online at: https://www.tecan.com/intellectual_property/patent_portfolio, Accessed from Internet on Mar. 12, 2021, 6 pages.
"Peristaltic Pump", Longer, Precision Pump-Longer Precision Pump Co., Ltd., Available Online at: https://www.longerpump.com/index.php/Pump/, Accessed from Internet on Mar. 12, 2021, 2 pages.
"Peristaltic Pumps", Bio-Chem Fluidics, Available Online at: https://biochemfluidics.com/products/peristaltic-pumps, Accessed from Internet on Mar. 12, 2021, 7 pages.
"Perth Suppliers of Commercial & Residential Water Pumps and Systems", Foundation Pump Service, Available Online at: http://www.foundationpumps.com.au/blog/history-pumps/, Accessed from Internet on Apr. 13, 2021, 5 pages.
"Prime Mover Actuators Compressors/Pumps Rotary Feedthroughs", Senior Operations LLC, Available Online at: https://www.metalbellows.com/assets/BellowsDevicesforVacuum.pdf, believed to be published by Apr. 1, 2020, 4 pages.
"Prior Art Searches and Patents", MaRS Startup Toolkit, Available Online at: https://learn.marsdd.com/marslibrary/searching-for-prior-art/, Accessed from Internet on Apr. 4, 2019, 2 pages.
"Product Selector", Saint-Gobain Process Systems, Available Online at: https://www.processsystems.saint-gobain.com/product-selector-panel/electronics?pc=546, Accessed from Internet on Mar. 15, 2021, 6 pages.
"Pump", Engineering, Britannica, Available Online at: https://www.britannica.com/technology/pump, Accessed from Internet on Mar. 16, 2021, 2 pages.
"Pump PFD2/PFS2 Operating Instructions", Saint Gobain, Available Online at: https://www.es-technologies.com/PFD2_PFS2%20Manual%20English%20USA_03_.pdf, Accessed from Internet on Jun. 12, 2019, 21 pages
"Pumps", GRI Pumps, The Pump People, Available Online at: https://www.gripumps.com/pumps/, Accessed from Internet on Mar. 12, 2021, 6 pages.
"Reading Claims for Infringement", Brown & Michaels, Available Online at: https://www.bpmlegal.com/content/howtopat8, Accessed from Internet on Mar. 12, 2021, 4 pages.
"RPP-Rotary Piston Pump", Foreach, Available Online at: http://www.foreachtek.com/en/ProductList.aspx?TypeId=10035, Accessed from Internet on Mar. 12, 2021, 2 pages.
"Saint Gobain PFD2 333 Asti All (PFA-coated) Double-Bellows Pumps 30 LPM, 5 bar, 3/4"flare connection", Cole-Parmer, Available Online at: https://www.coleparmer.ca/i/saint-gobain-pfd2-333-asti-all-pfa-coated-double-bellows-pumps-30-lpm-5-bar-3-4-flare-connection/7620015, Accessed from Internet on Mar. 15, 2021, 3 pages.
"Saint-Gobain Performance Plastics, A Leading Producer of Polymer Product Technology", Available Online at: https://www.plastics.saint-gobain.com, Accessed from Internet on Jun. 12, 2019, 3 pages.
"SM-Mini Piston Pump", Foreach pumps, Available Online at: http://www.foreachtek.com/en/ProductList.aspx?TypeId=10034, Accessed from Internet on Mar. 12, 2021, 2 pages.
"Solenoid Operated Micro Pumps", Bio-Chem Fluidics, Available Online at: https://biochemfluidics.com/products/solenoid-operated-micro-pumps, Accessed from Internet on Mar. 12, 2021, 5 pages.
"Spela Pillar Bellows Pump PE Series", Available online at http://www.nipponpillar.com/wp-content/uploads/PE_Series_Medium_Temp_Brochure.pdf, Accessed from Internet from Jun. 12, 2019, 2 pages.
"Syringe Pump", Laboratorial Syringe Pump, Industrial syringe Pump-Longer Precision Pump Co., Ltd., Available Online at: https://www.longerpump.com/index.php/SyringePump/, Accessed from Internet on Mar. 12, 2021, 2 pages.
"Term of Patent", Wikipedia, Available Online at: https://en.wikipedia.org/wiki/Term_of_patent, Accessed from Internet on Mar. 12, 2021, 3 pages.
"The History of Pumps", Timeline 2000 BC to Now, Available Online at: https://pressurewasherify.com/blog/pumps-history/, Accessed from Internet on Mar. 12, 2021, 75 pages.
"Tricontinent's Solutions for High-Precision Liquid Handling", Liquid-handling products and instruments, Available Online at: https://www.gardnerdenver.com/en-ca/tricontinent/products, Accessed from Internet on Mar. 12, 2021, 4 pages.
"Vacuum Cups & Bellows", Norgren, Available Online at: https://www.norgren.com/uk/en/list/vacuum/vacuum-cups-and-bellows, Accessed from Internet on Mar. 12, 2021, 26 pages.
"Vacuum Pumps", Norgren, Available Online at: https://www.norgren.com/uk/en/list/vacuum/vacuum-pumps, Accessed from Internet on Mar. 12, 2021, 9 pages.
PCT/US2021/023845 , "International Preliminary Report on Patentability", Oct. 13, 2022, 6 pages.
European Application No. 21781910.1, Extended European Search Report mailed on Feb. 12, 2024, 9 pages.

* cited by examiner

PRECISION VOLUMETRIC PUMP WITH A BELLOWS HERMETIC SEAL

CROSS REFERENCE TO RELATED APPLICATIONS

This application claims priority to and the benefit of U.S. provisional patent application Ser. No. 63/004,126, filed on Apr. 2, 2020, which is hereby incorporated by reference as if fully set forth herein.

FIELD OF THE DISCLOSURE

The present disclosure relates generally to precision pumps and, more particularly, to a precision volumetric pump with a bellows hermetic seal.

BACKGROUND

Various clinical and diagnostic instruments may include one or more precision fluid pumps that operate volumetrically to provide a desired dispense volume. Such volumetric pumps may be used to pump sample fluids and various reagents, including reagents that include salts, detergents, or other potentially corrosive or reactive species. For example, salts and detergents may be used to transfer or washout sample fluids without promoting organic growth, such as on interior surfaces of an instrument in fluid communication with such reagents.

However, exposure to these kinds of reagents that are commonly used in various types of analytic instruments may be problematic with regard to the seals of conventional volumetric pumps, such as conventional volumetric pumps that employ a piston or a plunger, including syringe-type volumetric pumps. Such conventional volumetric pumps typically have a dynamic seal about the pumping element (e.g., the piston or the plunger) that is a dynamic seal that experiences rubbing or wearing between the seal and another surface (e.g., as the plunger is actuated the seal moves in a longitudinal direction rubbing or wearing against a surface as it moves). Such a dynamic seal may represent a constraint on the length of the service life of the conventional volumetric pump due to degradation of the seal over time due to the rubbing/wearing of the seal. In some conventional volumetric pumps, detergents used therein typically have a low-surface tension that can be prone to leakage at the seals of a conventional volumetric pump. In another example, saline solutions may be prone to precipitate formation at the seals that can accelerate the failure of a conventional volumetric pump.

SUMMARY

A precision volumetric pump with a bellows hermetic seal provides for a permanently sealed pump that does not include a dynamic seal, and therefore, may eliminate various adverse consequences associated with the dynamic seal, including but not limited to failure or leaking of the dynamic seal. A precision volumetric pump according to aspects of the present disclosure can include a bellows capsule positioned within a pump housing and coupled to a drivetrain system. The bellows capsule is hermetically sealed to a housing of the drivetrain by a static seal and may modulate its volume in response to a linear movement of a nut (or ferrule) of the drivetrain. The pump housing may also be hermetically sealed to the drivetrain housing and may be sized and shaped such that the bellows capsule modulates within the pump housing without contacting an inner surface of the pump housing. A sum of the volume of the bellows capsule and a pump chamber defined by the space between the inner surface of the pump housing and the bellows capsule remains constant. In other words as the volume of the bellows capsule increases, the volume of the pump chamber decreases, likewise as the volume of the bellows capsule decreases, the volume of the pump chamber increases.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
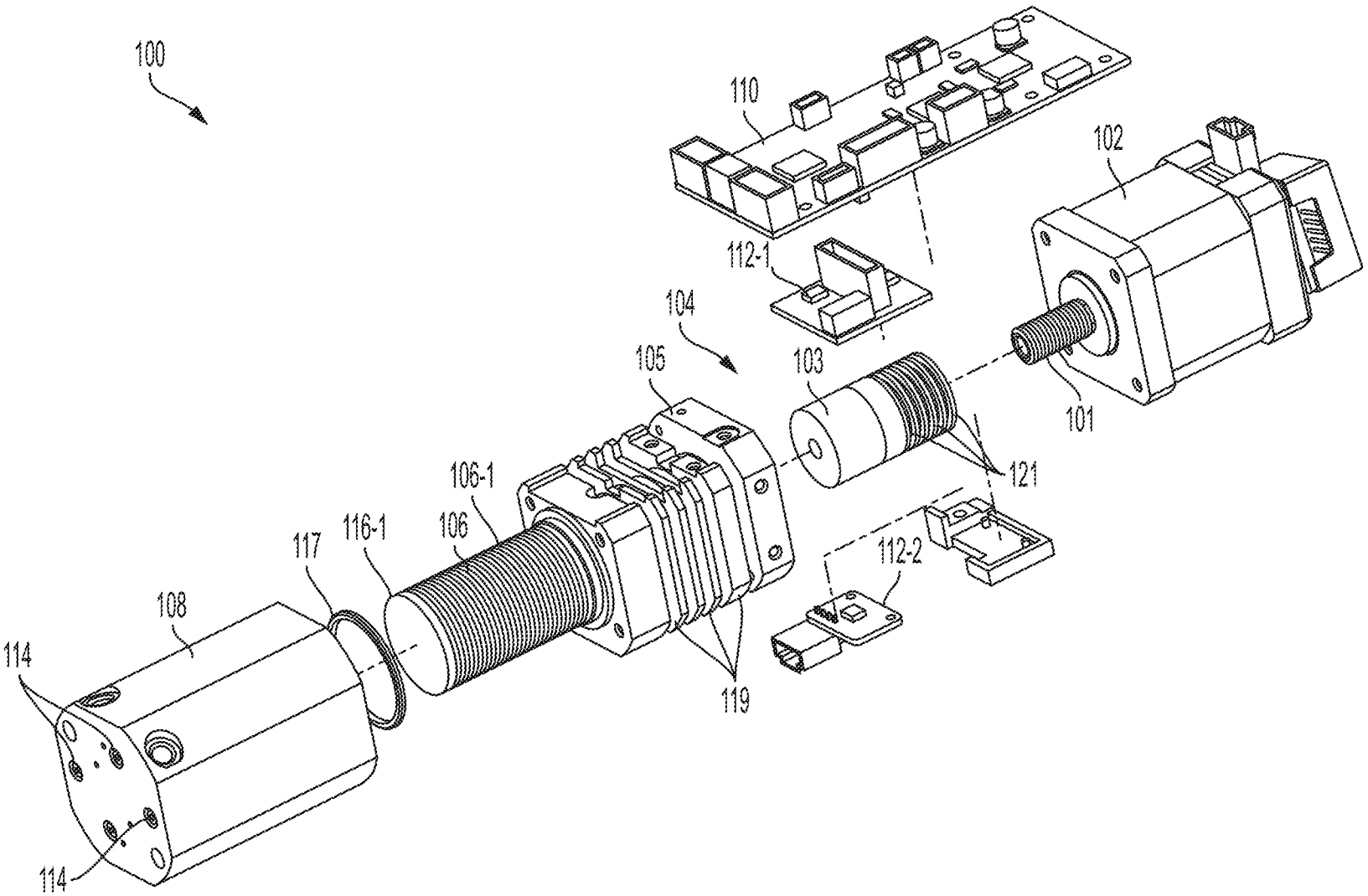
FIG. 1 depicts an exploded view of a precision volumetric pump with a bellows hermetic seal.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

As noted previously, conventional volumetric pumps used in various types of clinical and diagnostic instruments typically comprise a dynamic seal about the pumping element (e.g., the piston or the plunger) that may be the source of leaks and pump failures. The dynamic seal in conventional volumetric pumps can so limit reliability and result in premature failure or excessive down time for servicing, which is economically undesirable. Furthermore, the placement of conventional pumps within clinical and diagnostic instruments has been limited to easily accessible locations in order to facilitate repeated servicing, and such instruments have included additional protective measures to prevent damage to other instrument components when undesired seal leakage from the conventional pump occurred.

As disclosed herein, a precision volumetric pump with a bellows hermetic seal that is a static seal is a permanently sealed pump that does not include a dynamic seal, and therefore, may eliminate various adverse consequences associated with the dynamic seal, as noted above. The precision volumetric pump with a bellows hermetic seal disclosed herein may prevent microleakage during an operational lifetime of the pump. The precision volumetric pump with a bellows hermetic seal disclosed herein may enable elimination of a service schedule, and so, enable avoiding of down time for servicing of the pump. The precision volumetric pump with a bellows hermetic seal disclosed herein may enable an analytical instrument in which the pump is used to forego leak protection measures and leak damage prevention arrangements. The precision volumetric pump with a bellows hermetic seal disclosed herein may enable an analytical instrument using the pump to have the pump located in any desired location within the instrument, regardless of accessibility for servicing. The precision volumetric pump with a bellows hermetic seal disclosed herein may provide a low compliance in operation that is commensurate with conventional pumps having a dynamic seal. The precision volumetric pump with a bellows hermetic seal disclosed herein may provide a first operational service life that is at least as long as a second operational service life of an analytical instrument in which the pump is used. As used herein, the terms "hermetic seal" and "hermetically sealed" refer to a seal that renders the object airtight at and around atmospheric pressure. As used herein, the term "static seal" refers to a seal that is not dynamic. As used herein, the term "dynamic seal" refers to a seal that experiences rubbing or wearing against another surface (e.g., between the walls of a chamber in which the seal moves in response to actuation of a plunger or piston).

Referring now to the drawings, FIG. 1 depicts an exploded view of a precision volumetric pump 100 with a bellows hermetic seal, as disclosed herein (also referred to simply as pump 100 herein). FIG. 1 is a schematic illustration and is not necessarily drawn to scale or perspective. It is noted that certain elements of pump 100 may be omitted or may be obscured from view in FIG. 1.

As shown in FIG. 1, pump 100 comprises a motor 102 enabled for controlled rotation. The pump 100 includes a drivetrain system 104, including a nut (or ferrule) 103 and a drivetrain housing 105. In various embodiments, motor 102 may be a stepper motor and may be coupled to the nut 103 of the drivetrain system 104 for translating the rotation of motor 102 into a linear motion of the nut 103. The nut 103 may be enabled for bidirectional operation in which the direction of rotation of motor 102 determines a direction of the linear motion of the nut 103, either forwards or backwards, with respect to motor 102, for example in the coaxial arrangement shown in FIG. 1. It is noted that a shaft 101 of motor 102 may be equipped with external threads that engage with threads of a leadscrew 115 positioned within the nut 103 (see also FIG. 2A). Nut 103 is positioned within the drivetrain housing 105 and is coupled to and drives a bellows capsule 106 within a pump housing 108. The pump housing 108 is sealed to the drivetrain housing 105 by a static seal 117. The pump housing 108 may be attached (such as by welding, adhesive, sealing, or other attachment means) to the drivetrain housing 105 with the static seal 117 positioned therebetween for providing a hermetic seal between the pump housing 108 and the drivetrain housing 105. In some aspects, some or all of the pump housing 108 may be transparent or translucent for ease of viewing the inflow and outflow of fluid within the pump housing 108 and the dispensing of the liquid by the pump 100. As shown in FIG. 1, bellows capsule 106 is enclosed by and reciprocates (or moves) within the pump housing 108. The pump housing 108 may include at least one external port 114 that can be coupled in fluid communication to external capillary conduits (not shown). It is noted that in some embodiments, a valve unit (not shown) may be coupled to ports 114 at pump housing 108, in order to control operation of pump 100 with respect to input conduits and output conduits.

Also shown in FIG. 1 is a control module 110 that may contain electronics enabled to drive motor 102 to control pump 100. Also visible are sensor modules 112, such as limit sensors 112-1 and a detector element 112-2 that may be coupled to drivetrain system 104 and may be enabled to monitor the motion or the pumping action of bellows capsule 106 in this manner. In some aspects, limit sensors 112-1 can include two Hall effect sensors that serve as limit switches and initialization positions for the bellows capsule 106. The limit sensors 112-1 can be calibrated to detect a specific field intensity for detecting a magnet ring 118 (see FIG. 2A) at a desired position. The magnet ring 118 may be positioned on the nut 103 and therefore the position of the magnet ring 118 may correspond to the position of the nut 103 and thereby the position of the bellows capsule 106. The limit sensors 112-1 can therefore be used in conjunction with the magnet ring 118 to prevent over compression or over extension of the bellows capsule 106 and allows for repeatable initialization before operation of the pump 100. For example, in a position in which the magnet ring 118 is positioned below a first limit sensor of the limit sensors 112-1 (corresponding to a detected predetermined magnetic field intensity), the bellows capsule 106 is therefore in a fully dispensed position, further extension of the bellows capsule 106 could over extend and damage the bellows capsule 106. In a position in which the magnet ring 118 is positioned below a second limit sensor of the limit sensors 112-1 (corresponding to a detected predetermined magnetic field intensity), the bellows capsule 106 is therefore in a fully aspirated position, further compression of the bellows capsule 106 could damage the bellows capsule 106.

As shown in FIG. 1, bellows capsule 106 may comprise a series of individual convolutes 106-1 (see also FIG. 2B) that may be ring-shaped and may be attached to each other, such as by bead welding, or by using another suitable bonding technique. The convolutes 106-1 of the bellows capsule 106 may comprise a material having sufficient strength, elasticity, and hydrophilicity properties. In some examples, the convolutes 106-1 of the bellows capsule 106 may comprise a metal material such as aluminum, stainless steel, titanium, including combinations of metals, or another material, such as a polymer, with substantially similar properties with respect to strength, elasticity, and hydrophilicity properties. In some aspects, the bellows capsule 106 may comprise a material having a yield strength of between about 200 and about 600 MPa. In some aspects, the bellows capsule 106 may have a modulus of elasticity between about 100 and about 225 GPA. In some aspects, the convolutes 106-1 may have a surface energy of between about 700 and about 1100 $mJ/m^2$. In some aspects, the hydrophilicity properties of the convolutes 106-1 may be achieved via a coating or surface treatment on a surface of the convolutes 106-1. In some aspects, the convolutes 106-1 may comprise 316L stainless steel. Each convolute 106-1 may accordingly have a bead weld at an inner radial edge and an outer radial (or circumferential) edge. Because of the ring shape of individual convolutes 106-1, the bonding of the inner radial edges forms an interior passageway within bellows capsule 106 (not visible in FIG. 1, see FIG. 2A). When so joined in aggregate, the individual convolutes 106-1 may comprise bellows capsule 106 that forms a spring-like sealed structure that is enabled to expand and retract and thereby precisely modulate its volume. In other words, the bellows capsule 106 may expand and retract thus increasing or decreasing, respectively, the outer surface area and by relation the volume of the bellows capsule 106.

Bellows capsule 106, as shown, may be attached at one end region 107 to a transmission shaft 116 (not visible in FIG. 1, see FIGS. 2A, 2B, 2C) where transmission shaft 116 extends radially to form an end plate 116-1. Transmission shaft 116 may pass through the interior passageway of bellows capsule 106 and is coupled to drivetrain system 104 at an opposing end region 109 of the transmission shaft 116 from end plate 116-1. An opposing end region 111 of bellows capsule 106 may be attached to drivetrain housing 105 as shown. The bonds or joints that form bellows capsule 106 and attach bellows capsule to end plate 116-1 and to drivetrain housing 105 may be solid state bonds that are hermetically sealed, such as bead welds among other types of bonds.

As shown in FIG. 1, pump housing 108 forms a relatively thick-walled pump chamber 204 that seals and encloses bellows capsule 106. Accordingly, pump housing 108 is attached to drivetrain housing 105 at one end region 113 that has a corresponding opening in pump housing 108 to receive bellows capsule 106. It is noted that pump housing 108 has a fixed seal with drivetrain housing 105 where bellows capsule 106 is also attached to drivetrain housing 105. However, pump housing 108 does not contact and does not form a seal with bellows capsule 106, which is enabled to move freely (i.e. modulate or expand and retract) within the pump chamber 204 (obscured from view in FIG. 1, see FIG. 2A) that is formed internally by pump housing 108 and is described in further detail below. Also visible in FIG. 1 are ports 114, which may enable fluid communication with capillary conduits or with a valve module (not shown). Ports 114 are in fluid communication with pump chamber 204 as will be shown with respect to FIGS. 2A and 2B.

In operation of pump 100, pump chamber 204 may first be primed with a liquid that is to be volumetrically dosed, while bellows capsule 106 may be at least partially retracted to increase the volume of pump chamber 204 where the volume of pump chamber 204 corresponds to a volume between the wall of pump housing 108 and bellows capsule 106. For example, one of ports 114 may be used to draw in the liquid into pump chamber 204. After pump chamber 204 is filled with the liquid and is primed by evacuating any air remaining in pump chamber 204, motor 102 may be operated to extend bellows capsule 106 by a specific volumetric amount within the pump chamber 204 (with respect to pump housing 108) that corresponds to a volume of the liquid that is dispensed by one of ports 114 used as an output conduit for pump 100. Specifically, as transmission shaft 116 is extended, bellows capsule 106 expands within pump chamber 204 and reduces the volume of pump chamber 204, thereby expelling the desired volume of the liquid. For example, a sum of a first volume of bellows capsule 106 and a second volume of pump chamber 204 may remain constant as bellows capsule 106 expands and contracts to modulate the first volume, resulting in corresponding modulation of the second volume. Furthermore, a force provided by motor 102 may translate into a pressure exerted by bellows capsule 106 on pump chamber 204 (the second volume). It is noted that bellows capsule 106 runs freely within pump chamber 204 and does not contact any surfaces of pump chamber 204, and therefore, does not dynamically seal with pump chamber 204.

The operation of motor 102 can result in increased heat. To prevent damage or wearing out of elements of the pump 100 due to the increased heat output by motor 102 during use, the pump 100 can also provide for improved heat dissipation. For example, the drivetrain housing 105 may include fins 119 which promote efficient convective cooling during operation of the pump 100 by pulling heat away from motor 102, leadscrew 115, and bellows capsule 106. In addition, the nut 103 may also include fins 121 which too promote efficient convective cooling during operation of the pump 100 by pulling heat away from motor 102, leadscrew 115, and bellows capsule 106. Reducing the temperature on the bearing surfaces may extend the life of lubrication and the performance of the pump 100. In addition, the heat exchange provided by fins 119 and 121 may also reduce the impact of heat transfer from motor 102 to the fluid in the pump 100 through the drivetrain housing 105 and leadscrew 115. In some aspects, the use of at least some fins on the drivetrain body, for example but not limited to fins 119, can reduce the temperature at end region 107 of the bellows capsule 106 by approximately five to approximately 15 degrees Celsius. In addition, the material of the pump housing 108 may also improve heat dissipating, for example using thermally conductive material for pump housing 108 can reduce the temperature of the leadscrew 115 and motor 102 by about 9 degrees Celsius during operation of the pump. Examples of thermally conductive material that may be used for the pump housing 108 may include, without limitation aluminum, a stainless steel, or a composite or thermally conductive polymer.

Figure 2A:
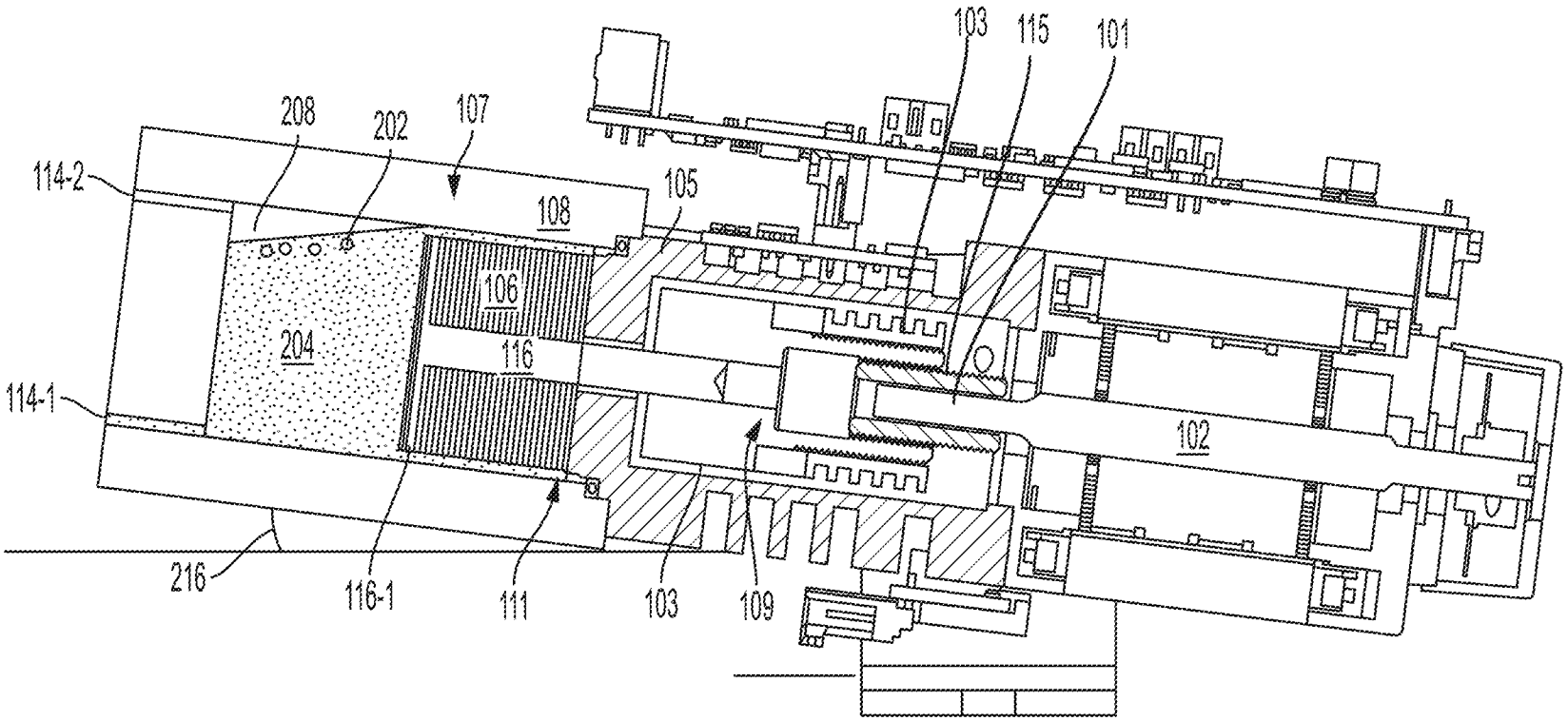
FIGS. 2A and 2B depict priming of bellows for air removal in the precision volumetric pump with the bellows hermetic seal.
Figure 2D:
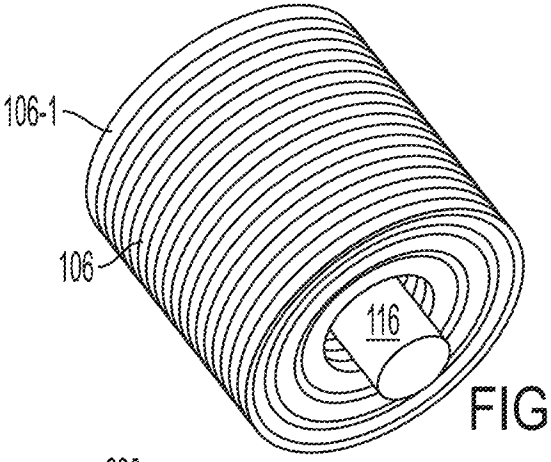
FIG. 2D depicts a perspective view of the bellows capsule of FIGS. 2A, 2B, 2C.
Figure 2C:
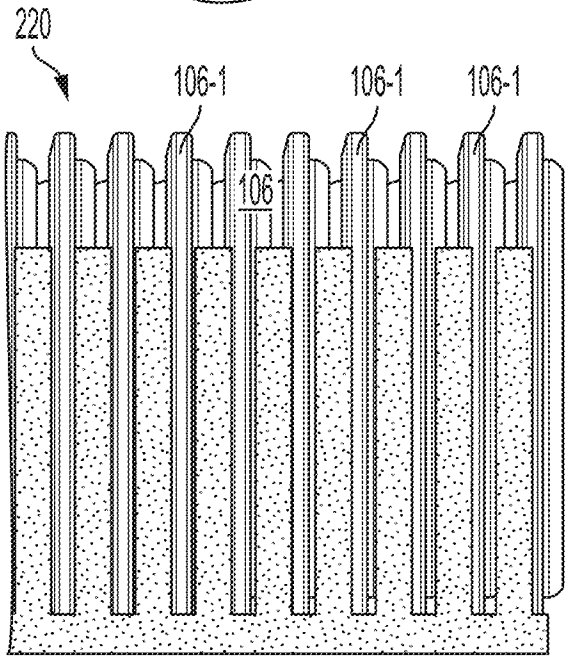
FIG. 2C depicts an enlarged portion of FIG. 2B.
Figure 7:
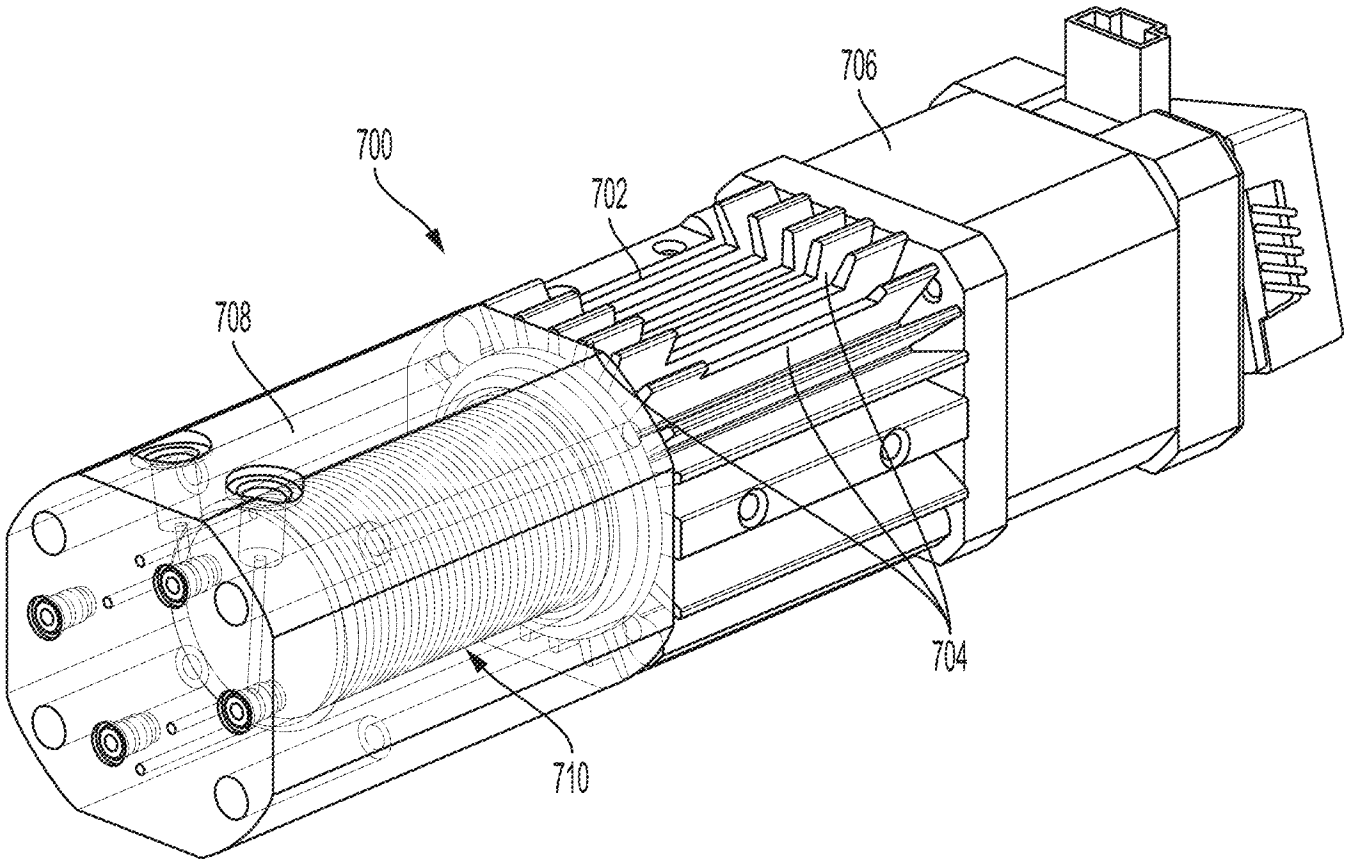
FIG. 7 depicts a perspective view of a precision volumetric pump with bellows hermetic seal according to aspects of the present disclosure.

While the pump 100 depicted in FIGS. 1-2C depicts a particular number and orientation of fins 119 and fins 121, in other aspects of the present disclosure different numbers and orientations of fins may be used. For example, FIG. 7 depicts a perspective view of a pump 700 according to aspects of the present disclosure. Pump 700 includes a drivetrain housing 702 comprising fins 704 for heat dissipation. Fins 704 differ in size, shape, number, and orientation from fins 119 of pump 100 while still providing heat dissipation. Additional sizes, shapes, numbers, and orientations of fins are contemplated for pumps disclosed herein. Pump 700 also includes a motor 706 and a pump housing 708 within which a bellows capsule 710 extends. The pump housing 708 is transparent to allow for viewing of the intake and dispensing of fluid by the pump 700. The pump 700 may include all or some of the features of pump 100 and operates in the same manner as pump 100. Pump 100 and pump 700 are shown and disclosed herein as including a static seal, however, in some aspects the static seal may be replaced with a dynamic seal or a dynamic seal may be included in the pump 100 and/or pump 700 without departing from the scope of the present disclosure.

Referring now to FIG. 2A, precision volumetric pump 100 with a bellows hermetic seal is shown in a sectional view. FIG. 2A is a schematic illustration and is not necessarily drawn to scale or perspective. It is noted that certain elements of pump 100 may be omitted or may be obscured from the sectional view provided in FIG. 2A. Visible in cross-section in FIG. 2A are motor 102, drivetrain system 104 including nut 103 and leadscrew 115 and drivetrain housing 105, pump housing 108, and bellows capsule 106 among other elements in an assembled state of pump depicted in FIG. 2A, and corresponding to exploded view 100-1 in FIG. 1.

It is noted that bellows capsule 106 may be equipped with certain features that enhance reliability and prevent damage or undesired operation. Specifically, transmission shaft 116 and end plate 116-1 may be designed to prevent any rotation of bellows capsule 106, which is desirable for preventing uncontrolled dispensing action or dispensing errors, such as when changing direction of movement of transmission shaft 116. Furthermore, bellows capsule 106 may be mounted to transmission shaft 116 in a preloaded manner with respect to an elastic force exerted by bellows capsule 106. Thus, the transmission threads that drive transmission shaft 116 may be subject to continuous force in one direction, which may substantially reduce or eliminate backlash or other mechanical uncertainty in operation of drivetrain system 104.

Also, the weld seam used to join or bond convolutes 106-1 to each other forms a solid homogeneous barrier that prevents the fluid being pumped from leaking. This solid state hermetic seal provided by bellows capsule 106 eliminates the dynamic seal used in conventional pump designs that slides across a mating sealing surfaces. As a result, the solid state hermetic seal provided by bellows capsule 106 is not impacted by variances or microtopology of the mating sealing surfaces and is not subject to the dynamic wear of the mating sealing surfaces during operation, resulting in a more reliable design of pump 100.

In FIG. 2A, pump 100 is depicted in a priming configuration and, accordingly, pump 100 is arranged at an angle 216 relative to a level surface in order to enable one end of pump 100 to be raised. The raised end of pump 100 shown in FIG. 2A includes pump chamber 204 and ports 114, shown as a first port 114-1 and a second port 114-2. As shown in sectional view 100-2, transmission shaft 116 and bellows capsule 106 are retracted, while pump chamber 204 is correspondingly enlarged. As shown, first port 114-1 has been opened to permit the liquid to fill pump chamber 204 as bellows capsule 106 retracts and expands the volume of pump chamber 204 in the interior of pump housing 108. A valve unit (not shown) having corresponding valves to open or close each of ports 114-1 and 114-2 may be used, such as by direct attachment to pump housing 108. The valve unit may include, for example, a solenoid valve.

As shown in the sectional view of FIG. 2A, as a result of the orientation of pump 100 at angle 216, second port 114-2 is higher than first port 114-2, while the fluid within pump chamber 204 has an angled surface as the level of the fluid rises and results in an angled void 208 that contains air. Angled void 208 is in fluid communication with second port 114-2 and serves to collect air bubbles 202 that may be present in the fluid at the highest point. Thus, after fluid is drawn into pump chamber 204, and bellows capsule 106 again begins to expand, angled void 208 begins to decrease in volume as the air is dispensed through second port 114-2, thereby removing air from pump chamber 204. After the air is removed and pump chamber 204 is filled with the fluid, pump 100 may be considered primed and ready for precise volumetric dispensing of the fluid through second port 114-2, for example, when first port 114-1 is closed (see also FIG. 2B).

Figure 2B:
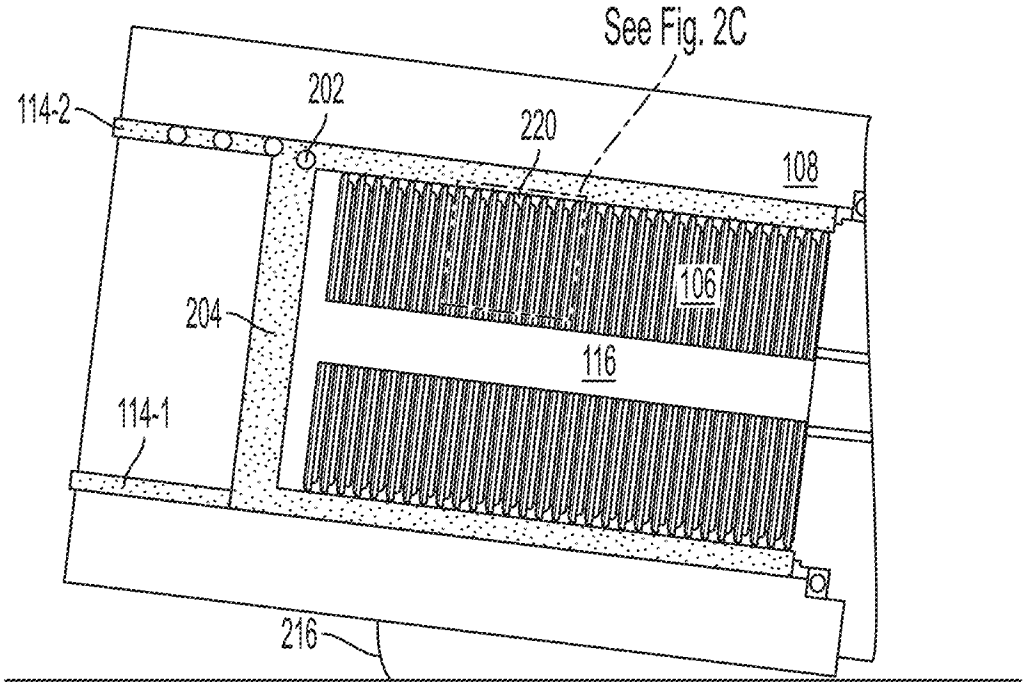

Referring now to FIG. 2B, precision volumetric pump 100 with a bellows hermetic seal is shown in a sectional view with the bellows capsule 106 in an expanded position as compared to the position of the bellows capsule 106 in FIG. 2A. FIG. 2B is a schematic illustration and is not necessarily drawn to scale or perspective. It is noted that certain elements of pump 100 may be omitted or may be obscured from view in FIG. 2B. FIG. 2B depicts pump housing 108 and pump chamber 204 in further detail and corresponds to a partially enlarged sectional view of FIG. 2A, with bellows capsule 106 in an expanded position as compared to the position of the bellows capsule 106 in FIG. 2A.

In FIG. 2B, first port 114-1 may be closed, while second port 114-2 may be used as an output port to dispense the fluid in pump chamber 204. As compared to FIG. 2A, in FIG. 2B bellows capsule 106 is extended with an increased volume, while pump chamber 204 has a decreased volume. The amount of volume of the pump chamber 204 that has decreased between FIG. 2A and FIG. 2B corresponds to an amount of fluid that has been dispensed. Also, in FIG. 2B, air bubbles 202 being evacuated via second port 114-2 are visible, as described above with respect to FIG. 2A.

Also shown in further detail in FIGS. 2B and 2D bellows capsule 106 is mounted to transmission shaft 116 and end plate 116-1, as described above, in an isolated perspective depiction for descriptive clarity. Also visible in FIG. 2D is the central opening in bellows capsule 106 that receives transmission shaft 116. FIG. 2C is an exploded view of a portion 220 of bellows capsule 106 depicting a plurality of convolutes 106-1 of bellows capsule 106. The area of exploded view 220 is shown in view 100-3 and corresponds to an outer edge of bellows capsule 106. Exploded view 220 depicts the action of hydrophilic surfaces of convolutes 106-1 that allow the fluid to wick up in the small voids between individual convolutes 106-1. As the fluid wicks up along the hydrophilic surfaces of convolutes 106-1, any air trapped therein may be displaced and may escape in the form of air bubbles 202 that are expelled at second port 114-2. As a result of these features, pump 100 may be primed to remove air bubbles in pump chamber 204 and provide precise volumetric operation with low compliance time, which is desirable.

Figure 3:
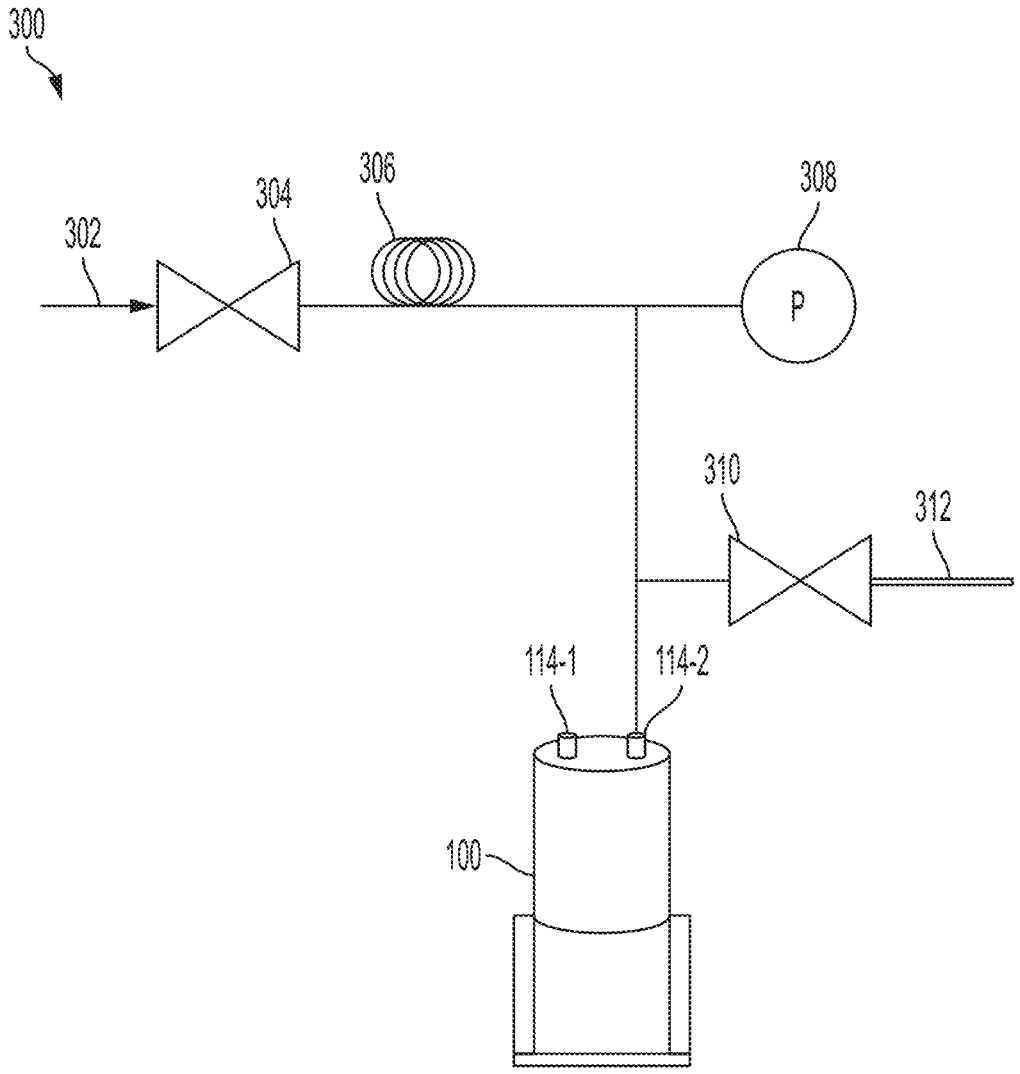
FIG. 3 depicts a pump compliance test configuration of the precision volumetric pump with the bellows hermetic seal to quantify performance with trapped air in the pump.

Referring now to FIG. 3, a pump compliance test configuration 300 is shown in a schematic process diagram. Test configuration 300 may be used to quantify air in pump 100 after the procedure to prime pump 100 and remove air bubbles 202, as described above, is performed, for example. As shown, test configuration 300 includes pump 100 having first port 114-1 and second port 114-2. For the purposes of test configuration 300, it may be assumed that first port 114-1 is closed, while pump 100 is filled with the fluid to be dispensed and second port 114-2 is open. Accordingly, a conduit extending from second port 114-2 may be in fluid communication with a first valve 304 that is enabled to receive an air injection 302. First valve 304 is connected to a holding loop 306 that increases volume of the conduit path, which is also in fluid communication with a pressure transducer 308. Additionally, a second valve 310 may be used as an output valve for expelling fluid to a capillary tube 312 (or another fluid sink in various embodiments).

In operation of test configuration 300, while second valve 310 is closed, a defined volume of air may be injected at air injection 302 into first valve 304 that is subsequently closed. In one compliance test, second valve 310 may be opened and a pumping pressure may be measured versus a volume of fluid dispensed as pump 100 operates (see also FIG. 4). In this manner, various compliance curves of pressure versus volume dispensed may be recorded and used to compare with a measured compliance curve of pressure versus volume dispensed of pump 100 in an operational state. By comparing the measured compliance curve of pressure versus volume dispensed with the reference curves, for example, an amount of air that may be trapped within pump 100 may be determined. In this manner, it may be determined when pump 100 is fully evacuated of air, as is desired for optimal operation.

In another compliance test using test configuration 300, both first valve 304 and second valve 310 may remain closed while pump 100 is operated. Then, a rise in pressure versus time may be recorded using pressure transducer 308, resulting in pressure compliance time curves (see also FIG. 5). In this manner, pressure compliance time curves for different pumps may be measured and used to characterize pump performance.

Figure 4:
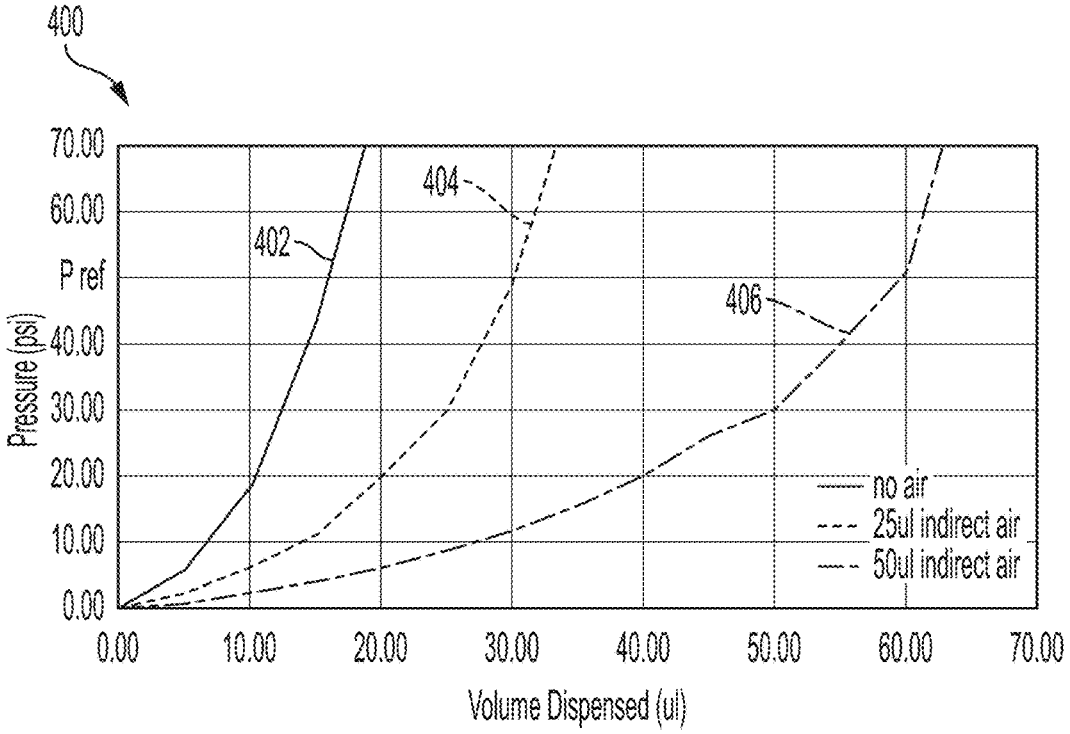
FIG. 4 depicts a pump compliance curve comprising pressure versus volume for the precision volumetric pump with the bellows hermetic seal.

Referring now to FIG. 4, a pressure-volume compliance plot 400 of different compliance curves of pressure versus volume dispensed are shown. In pressure-volume compliance plot 400, curves 402, 404, and 406 show a pump condition with increasing levels of air that has been injected into the pumping volume. The curves shown in plot 400 are indicative of pump 100 and may be measured using test configuration 300, shown and described above with respect to FIG. 3. Specifically, curve 402 may show measurement data for no trapped air and may represent a minimum curve or a reference curve. Thus, when a similar curve as curve 402 is measured for a pump, it can be assumed that the pump is operating without any internal trapped air, which is desirable. Curve 404 may show a first amount of air that is greater than the case of curve 402 (no trapped air). Curve 406 may show a second amount of air that is greater than the case of curve 404 having the first amount of air. Although direct comparison of curves may be used, another metric using a reference pressure level, shown as P ref in plot 400, may be used for a simpler quantitative evaluation of the curves in plot 400. For example, a volume dispensed at the reference pressure P ref may be used as a quantitative measure to evaluate trapped air in pump 100. Accordingly, curve 402 would show the smallest dispensed volume at P ref, followed by curve 404, followed by curve 406.

Figure 5:
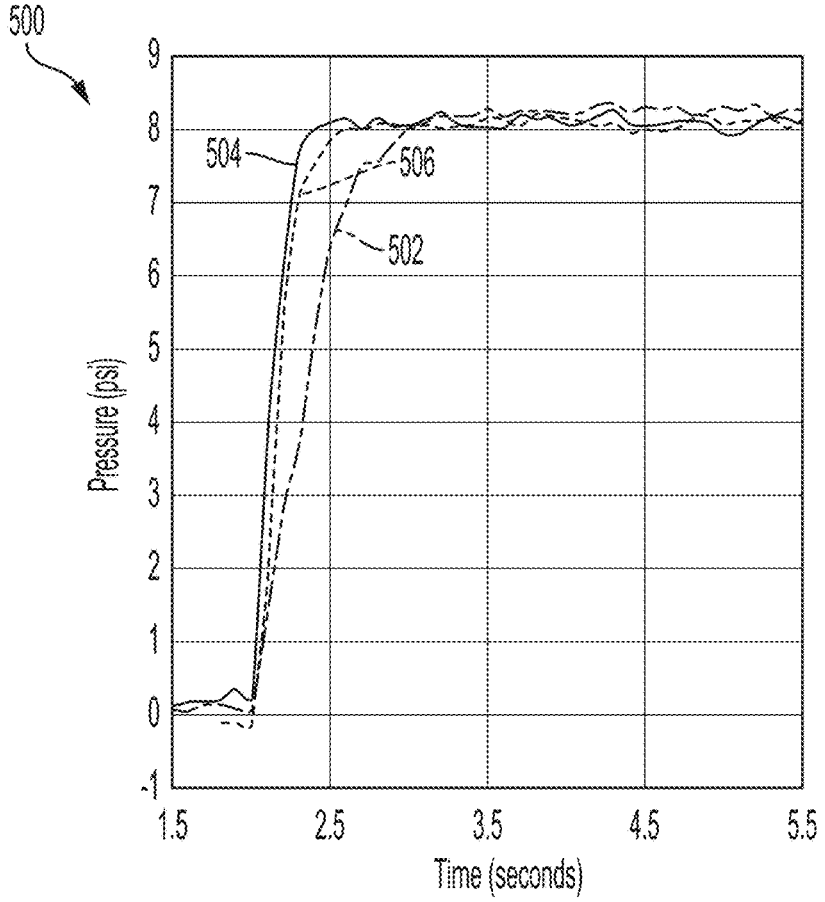
FIG. 5 depicts a pump compliance curve comprising pressure versus time for the precision volumetric pump with the bellows hermetic seal.

Referring now to FIG. 5, a pressure compliance time plot 500 of different pressure compliance time curves are shown. In pressure compliance time plot 500, compliance time curves 502, 504, and 506 show different compliance time for different pump designs under the same conditions. The compliance time may represent a response time of a pump to attain a steady state volumetric dispensing rate (e.g., flow rate). Specifically, compliance time curve 504 describes a conventional pump having a dynamic seal, such as a piston pump corresponding to curve 504. Compliance time curves 502 and 506 describe the compliance time behavior for precision volumetric pumps disclosed herein. For example, compliance time curve 506 describes the compliance time behavior for precision volumetric pump 100 with a bellows hermetic seal, as disclosed herein. As evident in pressure compliance time plot 500, the compliance time for a precision volumetric pump 100 according to embodiments of the present disclosure, including but not limited to precision volumetric pump 100, is comparable to conventional pumps having a dynamic seal, which is desirable and indicates that no sacrifice in pump performance in comparison to conventional pump designs is enabled by pump 100.

The precision volumetric pump 100 with a bellows hermetic seal disclosed herein may provide unique features and benefits as compared to conventional or other types of precision volumetric pumps. A geometry, span (e.g., convolute diameter), and material composition of bellows capsule 106 may be selected to minimize compliance time as pressure is increased or decreased during operation. The compliance time may determine the time for pressure to stabilize during and after a precision dispensing operation by the pump. Although a hollow cylindrical geometry of bellows capsule 106 is shown and described herein for descriptive clarity, it is noted that other shapes or geometries of bellows capsules may be used in various implementations. With regard to material, a corrosion resistant metallic composition of bellows capsule 106 is shown and described herein. Also described herein is a hydrophilic surface of convolutes 106-1, which may be attained with various types of surface treatments or surface coatings, particularly when corresponding aqueous liquids are dispensed, for example the surface treatment may improve chemical resistance. In some aspects of the present disclosure, the bellows capsule 106, for example an outer surface of the bellows capsule 106, may undergo a metal passivation, for example but not limited a nitric acid passivation following the manufacturing weld process that forms the bellows capsule 106. The nitric acid passivation of the bellows capsule 106 may provide an outer surface (defined for example by convolutes 106-1) that has been passivated and which may aid in preventing corrosion of the bellows capsule 106, for example during cleaning of the pump 100 when the bellows capsule 106 may be exposed to sodium hypochlorite or other corrosive chemicals. Prevention of corrosion of the bellows capsule 106 can aid in preventing failures of the pump 100 over time.

Furthermore, the material, weld bead type, and convolute spacing (e.g., convolute pitch) may be selected to promote the wetting of surfaces and minimize or eliminate trapped air during priming of pump 100, and such design features may be selected dependent on the liquid that pump 100 is designed to dispense. As noted above, any trapped air within pump 100 or in the transport system in fluid communication with pump 100 may adversely affect dispensing volume precision and compliance time behavior. Also, a stroke length of bellows capsule 106, along with mechanical properties, such as stiffness, and number of convolutes 106-1 may be selected to optimize (e.g., extend or maximize) a duration of the service life of the hermetic seal of bellows capsule 106 to prevent surface cracks as a result of material fatigue from developing. In this manner, a particular design of bellows capsule 106 may enable the service life of pump 100 to exceed instrument service life requirements with a high degree of confidence. For example, it is noted that accelerated fatigue testing of bellows capsule 106 has indicated a service life of pump 100 that can exceed 12 million cycles.

As disclosed herein, a precision volumetric pump 100 with a bellows hermetic seal provides compliance time performance comparable to a conventional pump having a dynamic seal. However, the precision volumetric pump with a bellows hermetic seal is enabled to operate over a very long service life with minimal or no maintenance without any propensity to develop leaks over the long service life.

Figure 6:
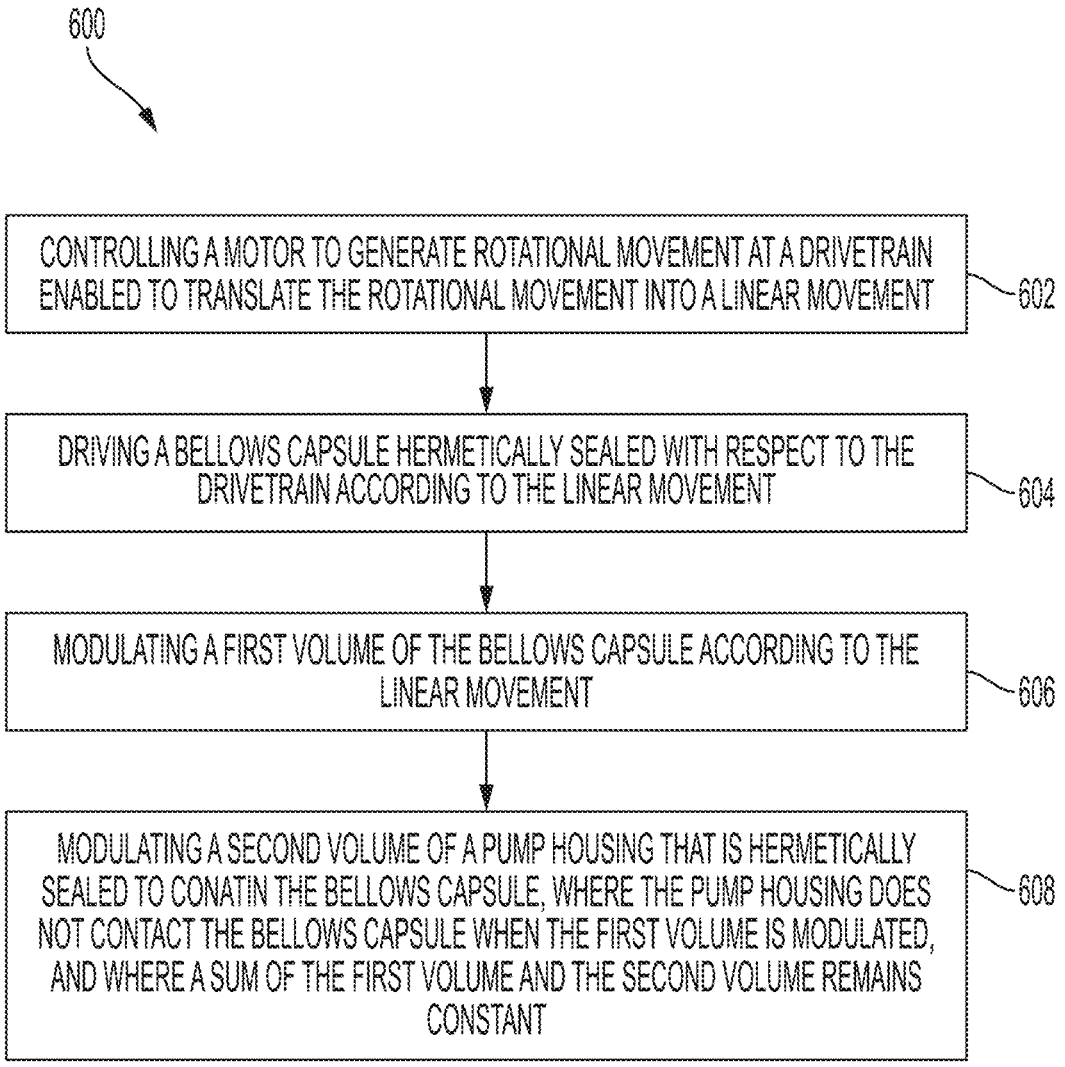
FIG. 6 is a flow chart of a method of operating a precision volumetric pump with a bellows hermetic seal.

FIG. 6 depicts a flow chart of a method 600 of operating a precision volumetric pump with a bellows hermetic seal, for example but not limited to pump 100. The method 600 may include at step 602 controlling a motor to generate rotation movement of a drivetrain (for example, but not limited to drivetrain system 104), the drivetrain being enabled to translate the rotational movement into a linear movement. At step 604 the method may include driving a bellows capsule (for example, but not limited to bellow capsule 106) according to the linear movement. The bellows capsule being hermetically sealed with respect to the drivetrain. At step 606 the method may include modulating a first volume of the bellows capsule according to the linear movement. Step 608 of the method 600 may include modulating a second volume of a pump housing or chamber (for example, but not limited to pump housing 108), where the pump housing does not contact the bellows capsule when the first volume is modulated and wherein a sum of the first volume of the bellows capsule and the second volume of the pump housing remains constant.

The precision bellows pump disclosed herein, for example but not limited to pump 100 and pump 700, can provide for precise dispensing of small volumes of liquid. For example, the precision bellows pumps contemplated by the present disclosure can provide for the dispensing of between about 1 μl and about 5000 μl of liquid, for example but not limited to between about 500 μl and about 2500 μl of liquid. Pumps contemplated by the present disclosure, including without limitation pump 100 and pump 700 can dispense liquid with a precision of 0.01% for the full volume dispense (i.e. a dispense or stroke of the full volume of the bellows pump). "Precision" or "precision value" as used herein refers to an average repeatability from stroke to stroke of a particular volume dispense. The pumps contemplated by the present disclosure, including without limitation pump 100 and pump 700 can deliver a predetermined volume per cycle with a precision value of less than 1% for a 2% of full volume dispense. In some aspects the pumps contemplated herein, including without limitation pump 100 and pump 700, can deliver a predetermined volume per cycle with precision value as shown below in Table 1.1 for the respective volume dispenses (or strokes) (shown below as a percentage of a full volume dispense of the pump):

| Stroke as Percentage of Full Volume Dispense | Precision Value |
|---|---|
| 0.10% | 1% |
| 1% | 0.20% |
| 10% | 0.04% |
| 100% | 0.01% |

In some aspects, the precision pumps disclosed herein, including but not limited to pump 100 and pump 700 can have precision value for various strokes according to the equation provided below where precision is represented in terms of % CV (Coefficient of Variation) and % CV=9E-05×(% Stroke)^−0.67:

$$CV = \frac{\sigma}{\mu}$$

where:

σ=standard deviation

μ=mean

Pumps contemplated by the present disclosure, including without limitation pump 100 and pump 700 can operate with a flow rate of between about 500 μl/min and about 300 ml/min.

Pumps disclosed herein as contemplated by the present disclosure, including but not limited to pump 100 and pump 700 can be used in connection with various clinical and diagnostic instruments and systems, for example but not limited to fluid drip-feeding devices, in bioprocessing and pharmaceutical systems, clinical chemistry, immunoassay, hematology, molecular diagnostics, Clustered Regularly Interspaced Short Palindromic Repeats ("CRISPR"), sample preparation, genetic sequencing, spatial biology, Polymerase Chain Reaction ("PCR") and HbA1c testing and processing, and similar applications. In some aspects, a precision volumetric pump is provided according to one or more of the following examples:

Example #1: A precision volumetric pump can include a bellows capsule enabled to expand and contract to modulate a first volume of the bellows capsule, wherein the bellows capsule is hermetically sealed relative to a drivetrain housing. The pump can also include a pump housing defining a chamber having a second volume that is hermetically sealed relative to the drivetrain housing to contain the bellows capsule when the pump housing is mounted to the bellows capsule, wherein the pump housing does not contact the bellows capsule when the bellows capsule modulates the first volume, and wherein a sum of the first volume and the second volume remains constant. In addition, the seal positioned between the pump housing and the drivetrain housing may be a static seal.

Example #2: The precision volumetric pump of Example 1, further featuring a drivetrain coupled to the bellows capsule to enable the bellows capsule to expand and contract linearly in response to rotational motion. In addition, the drivetrain may be positioned within the drivetrain housing. The pump may also include a motor to provide the rotational motion to the drivetrain.

Example #3: The precision volumetric pump of any of Examples 1-2, further featuring the bellows capsule further including a plurality of convolutes joined together by material bonding at respective edges of the convolutes.

Example #4: The precision volumetric pump of Example #3, further featuring a surface portion of the plurality of convolutes comprising a hydrophilic surface.

Example #5: The precision volumetric pump of Example #3, further featuring the pump housing comprising a port to enable purging of air bubbles from the chamber of the pump housing of the precision volumetric pump when the precision volumetric pump is inclined at an angle.

Example #6: The precision volumetric pump of Example #3, further featuring the convolutes comprising a metal material and the material bonding includes a weld seam.

Example #7: The precision volumetric pump of any of Examples #1-6, further featuring the bellows capsule being enabled for a service life of at least 7 million cycles.

Example #8: The precision volumetric pump of any of Examples #1-7, further featuring the bellows capsule including a surface treatment for improving chemical resistance on an outer surface of the bellows capsule.

Example #9: The precision volumetric pump of any of Examples #1-8, further featuring the outer surface of the bellows capsule comprising a passivated metal material.

Example #10: The precision volumetric pump of any of Examples #1-9, further featuring the bellows capsule being prevented from rotating during operation.

Example #11: The precision volumetric pump of any of Examples #1-10, further featuring a drivetrain, wherein the drivetrain may further comprise a threaded connection between the motor and the bellows capsule.

Example #12: The precision volumetric pump of Example #11, further featuring the threaded connection being preloaded with a linear force provided by the bellows capsule.

Example #13: The precision volumetric pump of any of Examples #1-12, further featuring the pump delivering a predetermined volume per cycle with a precision value of less than 1% for a 2% of full volume dispense.

Example #14: The precision volumetric pump of Example #1-13, further featuring the pump delivering a predetermined volume per cycle with precision value of approximately 0.2% for a dispense of 1% of full volume.

Example #15: The precision volumetric pump of Example #3, further featuring the plurality of convolutes comprising the same shape or size.

Example #16: The precision volumetric pump of any of Examples #1-15, further featuring the pump being adapted to deliver a liquid volume of 0.1% to 100% of a full 500 μl pump per cycle.

Example #17: The precision volumetric pump of any of Examples #1-16, wherein the pump is adapted to deliver a liquid volume of 0.1% to 100% of a full 2500 μl pump per cycle.

Example #18: The precision volumetric pump of any of Examples #1-17, further featuring the pump being operable over a pressure range of a vacuum to 100 PSI.

Example #19: A method of operating a precision volumetric pump may include controlling a motor to generate rotational movement, also including translating, by a drivetrain, the rotational movement into a linear movement, and also including driving a bellows capsule hermetically sealed with respect to a drivetrain housing according to the linear movement. The method also includes, responsive to driving the bellows capsule, modulating a first volume of the bellows capsule according to the linear movement, as well as responsive to modulating the first volume, modulating a second volume of a pump chamber of a pump housing, wherein the pump housing is hermetically sealed to the drivetrain housing. The method further comprises the bellows capsule being positioned within the pump chamber of the pump housing such that the pump housing does not contact the bellows capsule when the first volume is modulated, and wherein a sum of the first volume and the second volume remains constant.

Example #20: The method of Example #19, further features translating the rotational movement of the motor to the drivetrain via a threaded connection between the drivetrain and the motor, and enabling the bellows capsule to expand and contract linearly in response to the linear movement of the drivetrain by coupling the drivetrain to the bellows capsule and preventing rotation of the bellows capsule relative to the drivetrain.

Example #21: The method of Example #20, further comprising the bellows capsule having a plurality of convolutes that joined together by material bonding at respective edges of the convolutes.

Example #22: The method of any of Examples #20-21, further comprising a surface portion of the convolutes comprising a hydrophilic surface.

Example #23: The method of Example #21, further featuring the plurality of convolutes comprising a metal and the material bonding includes a weld seam.

Example #24: The method of any of Example #19-23, further featuring using the bellows capsule for a service life of at least 7 million cycles.

Example #25: The method of Example #19-24, further featuring an outer surface of the bellows capsule comprising a passivated metal material.

Example #26: The method of Example #1-25, further featuring removing air bubbles from the pump housing via a port.

Example #27: The method of Example #20, further featuring translating the rotational movement of the motor to the drivetrain via a threaded connection between the drivetrain and the motor further comprises rotating the threaded connection under a preload by a linear force provided by the bellows capsule.

Example #28: The method of any of Examples #19-27, further featuring the pump delivering a volume of 500 μl or 2,500 μl with each cycle.

Example #29: The method of any of Examples #19-28, further featuring the pump delivering a volume of between 250 μl and 5,000 μl per cycle.

Example #30 The method of any of Examples #19-29, further featuring the pump delivering a predetermined volume per cycle with a precision value of 0.01% for a full volume dispense.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A precision volumetric pump, comprising:

a bellows capsule that comprises a plurality of individual convolutes, wherein each convolute of the plurality of individual convolutes is joined to at least one other convolute of the plurality of individual convolutes by a metal weld, wherein the bellows capsule is enabled to expand and contract to modulate a first volume of the bellows capsule, wherein the bellows capsule is hermetically sealed relative to a drivetrain housing of a drivetrain system, and wherein the plurality of individual convolutes each comprise a metal, and wherein the individual convolutes comprise a ring shape;

a pump housing defining a chamber in which the bellows capsule is positioned, wherein the pump housing is hermetically sealed relative to the drivetrain housing via a seal positioned between the pump housing and the drivetrain housing, wherein an inner surface of the pump housing does not contact the bellows capsule when the bellows capsule modulates the first volume, wherein the chamber of the pump housing, a front surface of the drivetrain housing, and the plurality of individual convolutes of the bellows capsule together define a fluid chamber having a second volume, and wherein a sum of the first volume and the second volume remains constant;

an end plate coupled to a first end of the bellows capsule and coupled to a shaft, wherein the seal positioned between the pump housing and the drivetrain housing is a static seal;

a drivetrain system having a threaded connection between the motor and the bellows, the drivetrain system comprising:

a nut positioned within the drivetrain housing and coupled to the bellows capsule via the shaft, the nut being movable in a linear direction in response to actuation of a motor;

a leadscrew positioned within the nut, the leadscrew comprising threads that engage with threads of an additional shaft coupled to the motor, for translating a rotation of the motor into a linear motion of the nut; and wherein the pump delivers a predetermined volume per cycle with a precision value of less than 1% for a 2% of full volume dispense, wherein the full volume dispense comprises a range from 1 μl to 5000 μl.

2. The precision volumetric pump of claim 1, wherein a surface portion of the plurality of individual convolutes comprises a hydrophilic surface.

3. The precision volumetric pump of claim 1, wherein the bellows capsule is enabled for a service life of at least 7 million cycles.

4. The precision volumetric pump of claim 1, wherein the bellows capsule includes a hydrophilic surface treatment on an outer surface of the bellows capsule.

5. The precision volumetric pump of claim 4, wherein the outer surface of the bellows capsule comprises a passivated metal material for improving chemical resistance.

6. The precision volumetric pump of claim 1, wherein the bellows capsule is prevented from rotating during operation.

7. The precision volumetric pump of claim 1, wherein the bellows capsule is rotationally fixed with respect to the threaded connection.

8. The precision volumetric pump of claim 7, wherein the threaded connection between the bellows capsule and the motor is preloaded with a linear force provided by the bellows capsule.

9. The precision volumetric pump of claim 1, wherein the pump delivers a predetermined volume per cycle with precision value of approximately 0.2% for a dispense of 1% of full volume.

10. The precision volumetric pump of claim 1, wherein each convolute of the plurality of individual convolutes comprise the same shape or the same size.

11. The precision volumetric pump of claim 1, wherein the pump is adapted to deliver a liquid volume of 0.1% to 100% of a full 500 μl pump per cycle.

12. The precision volumetric pump of claim 1, wherein the pump is adapted to deliver a liquid volume of 0.1% to 100% of a full 2500 μl pump per cycle.

13. The precision volumetric pump of claim 1, wherein the pump is operable over a pressure range of a vacuum to 100 PSI.

14. The precision volumetric pump of claim 1, wherein at least a portion of the pump housing is adapted to allow viewing of the fluid within the pump housing.

15. The precision volumetric pump of claim 1, wherein the pump housing includes at least one external port adapted for fluid communication with an external capillary conduit.

16. The precision volumetric pump of claim 1, further comprising a limit sensor that is coupled to the drivetrain system.

17. The precision volumetric pump of claim 16, wherein the limit sensor comprises a Hall effect sensor and is adapted to prevent at least one of over compression or over extension of the bellows capsule.

18. The precision volumetric pump of claim 16, further comprising an additional limit sensor that is coupled to the drivetrain system for preventing the other of over compression or over extension of the bellows capsule.

19. The precision volumetric pump of claim 1, wherein the bellows capsule comprises a material having a yield strength of between about 200 MPa and about 600 MPa.

20. The precision volumetric pump of claim 1, further comprising a shaft positioned within an interior passageway of the bellows capsule, wherein the shaft is coupled at a first end to the end plate of the bellows capsule, wherein the shaft moves in a linear direction in response to actuation of a motor for controlling the expansion and retraction of the bellows capsule to modulate a first volume of the bellows capsule.

21. The precision volumetric pump of claim 1, wherein the pump delivers a predetermined volume per cycle with a precision value of 1% for a 0.01% of full volume dispense.

22. The precision volumetric pump of claim 1, wherein the pump delivers a predetermined volume per cycle with a precision value of 0.04% for a 10% of full volume dispense.

23. The precision volumetric pump of claim 1, wherein the pump delivers a predetermined volume per cycle with a precision value of 0.01% for a 100% of full volume dispense.

24. The precision volumetric pump of claim 1, wherein the pump delivers a liquid volume of between volume of 0.1% to 100% of a full pump per cycle, wherein the pump delivers a volume of between 500 μl and 2,500 μl with each 100% full pump per each cycle.

* * * * *